US005842614A

United States Patent [19]

Morrow

[11] Patent Number: 5,842,614

[45] **Date of Patent: *Dec. 1, 1998**

[54] BACKPACK FRAME AND SUPPORT POLE ASSEMBLY

[76] Inventor: John T. Morrow, 212 W. Graham, Lake Elsinore, Calif. 92530

[ * ] Notice: The term of this patent shall not extend beyond the expiration date of Pat. No. 5,642,846.

[21] Appl. No.: 868,524

[22] Filed: Jun. 4, 1997

Related U.S. Application Data

[63] Continuation-in-part of Ser. No. 543,341, Oct. 16, 1995, Pat. No. 5,642,846.

[51] Int. Cl.[6] ..... A45F 3/08

[52] U.S. Cl. ..... 224/261; 224/259

[58] Field of Search ..... 224/261, 262, 224/263, 259

[56] References Cited

U.S. PATENT DOCUMENTS 3,563,431 2/1971 Pletz ..... 224/263

5,642,846 7/1997 Morrow ..... 224/576

*Primary Examiner*—David J. Walczak

*Attorney, Agent, or Firm*—Loyal McKinley Hanson

[57] ABSTRACT

A backpack frame and support assembly includes a backpack frame together with first, second, and third poles and first, second, and third couplings that removably couple the poles to a backpack frame to form a tripod-like support configuration. The couplings hold the poles so that the poles angle away from the backpack frame advantageously for improved stability. In addition, the couplings hold the poles in a way enabling a user to remove the poles easily by lifting the backpack frame. The couplings may be part of the backpack frame, they may be attached to a backpack frame as original equipment, or they may be mounted as retrofit equipment on an existing prior art backpack frame. The poles in one embodiment slide together to form a walking staff or two trekking poles, and a separate hook attaches to the third pole to adapt it to use in mounting a bear bag over a tree limb.

14 Claims, 5 Drawing Sheets

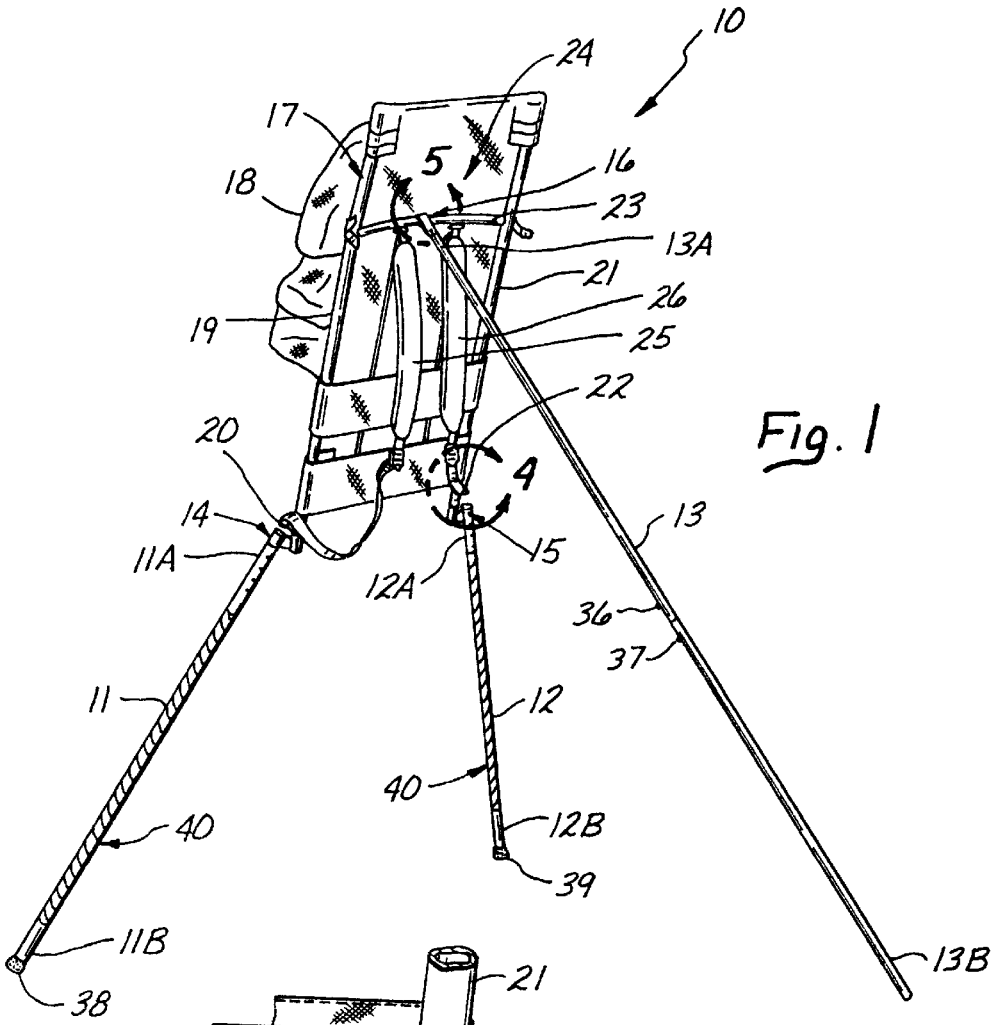
Fig. 1
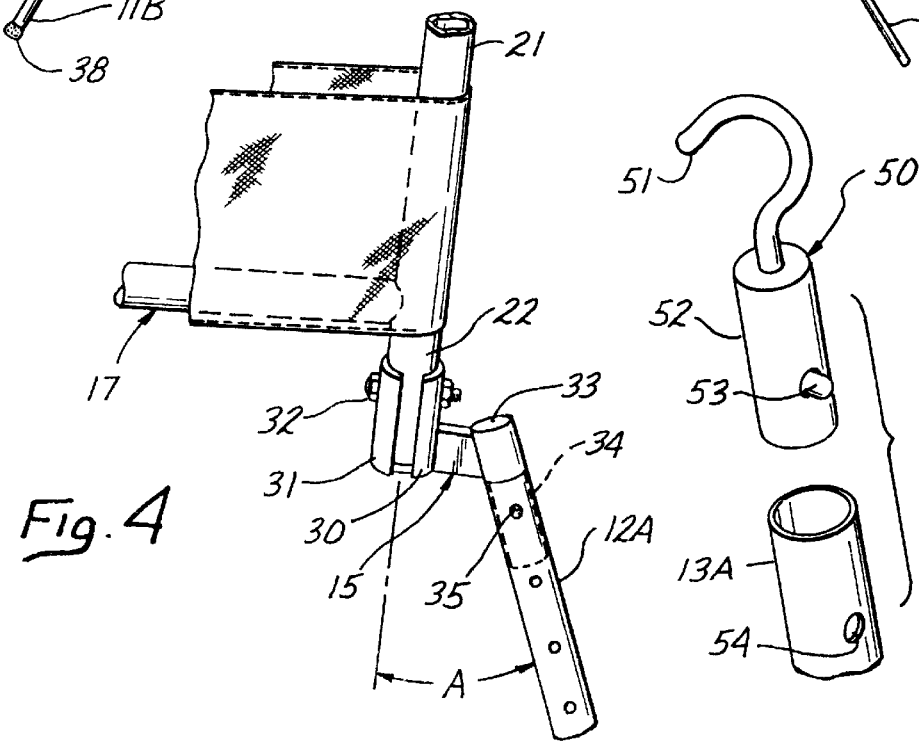
Fig. 4
Fig. 8

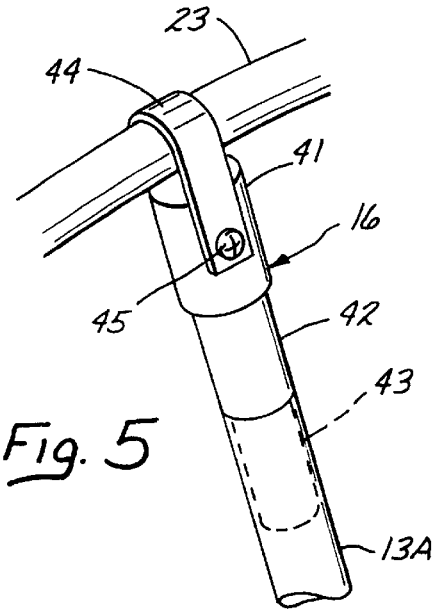
Fig. 5
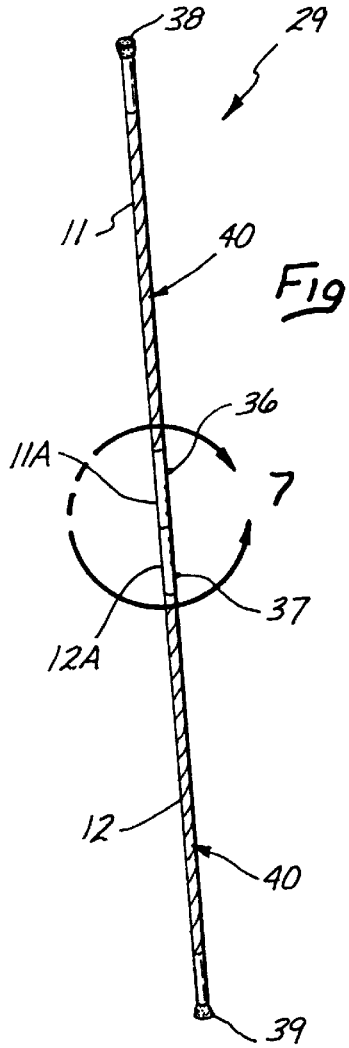
Fig. 6
Fig. 9
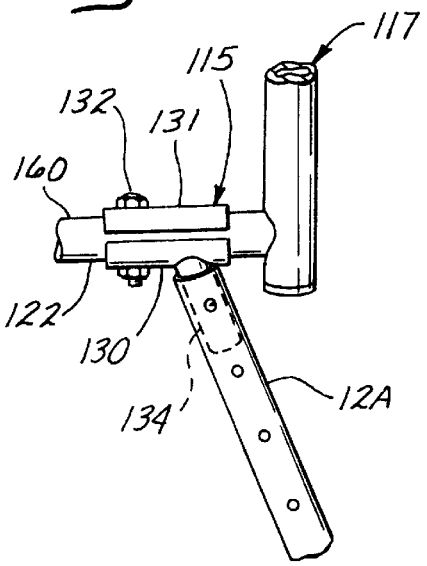
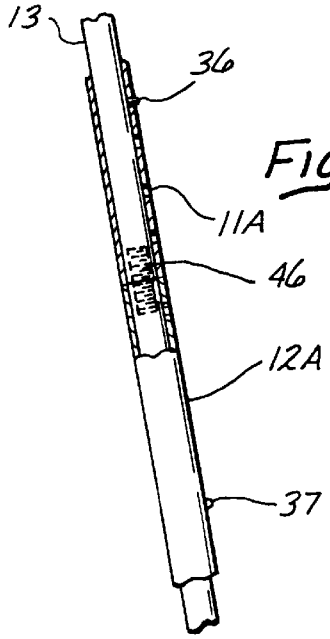
Fig. 7

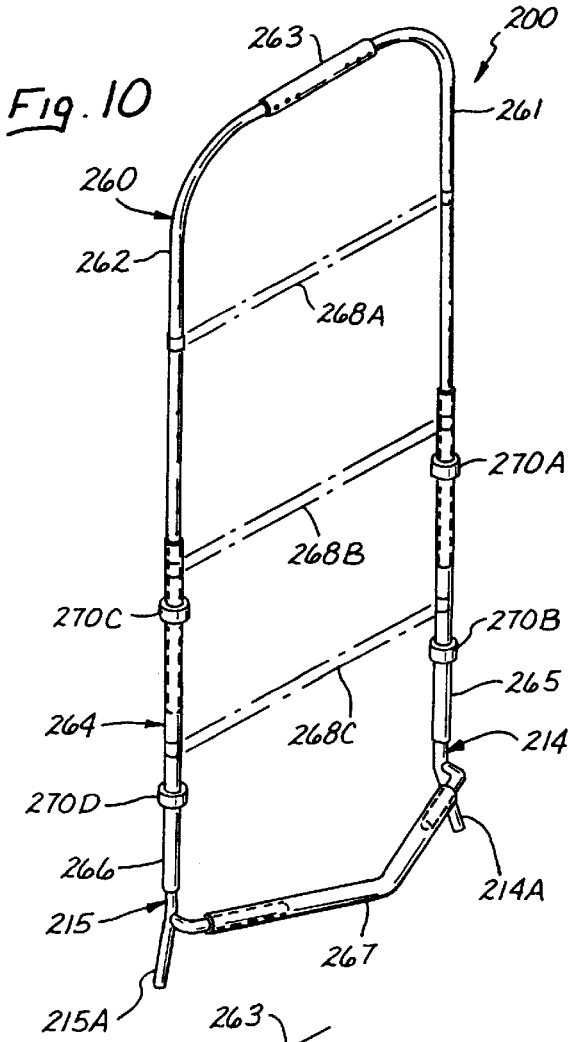
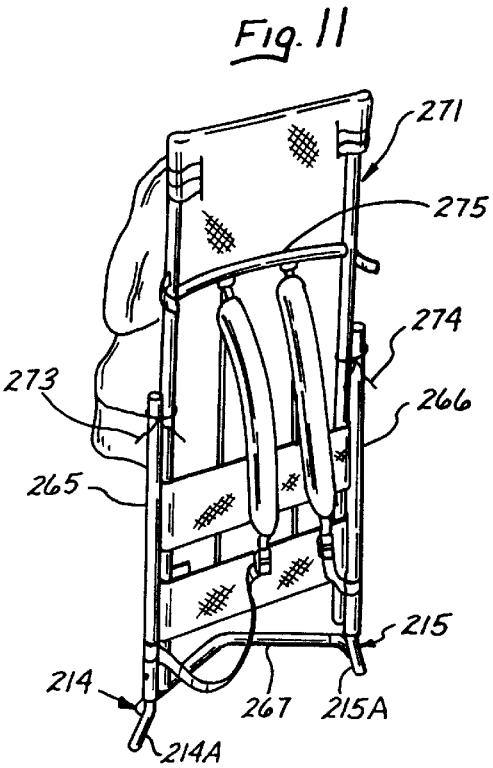
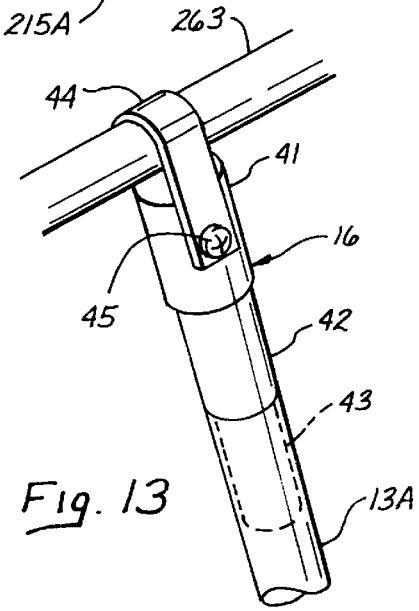
Fig. 13
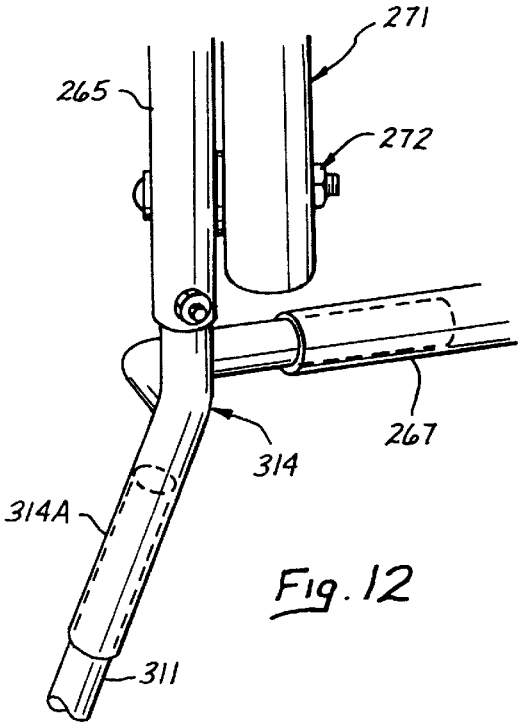
Fig. 12

BACKPACK FRAME AND SUPPORT POLE ASSEMBLY

CROSS-REFERENCE TO RELATED APPLICATIONS

This application is a continuation in part of the U.S. patent application naming the same inventor that was filed Oct. 16, 1995 and assigned Ser. No. 08/543,341. That application is issuing as U.S. Pat. No. 5,642,846 on Jul. 1, 1997.

BACKGROUND OF THE INVENTION

1. Technical Field

This invention relates generally to camping and hiking equipment, and more particularly to a backpack frame and support apparatus that enables a user to support a backpack upright when not worn in order to facilitate removal and replacement of the backpack on a user's back.

2. Description of Related Art

As related in the parent application issuing as U.S. Pat. No. 5,642,846 a typical backpack -includes a backpack frame fabricated from aluminum tubing or other lightweight material to provide a strong, rigid, lightweight, and comfortable platform on which the user mounts one or more packs and various other equipment. But, the combination of the backpack frame and the equipment may weigh fifty pounds or more, and so removal and replacement of the backpack on the user's back can be awkward and somewhat difficult.

U.S. Pat. No. 5,381,936 discusses that and other aspects of backpacks in describing a backpack support apparatus that facilitates removal and replacement of the backpack. Despite its usefulness, the support apparatus described in that patent fails to resolve certain other problems. For one thing, the spring-loaded telescopic legs may add unacceptable weight, complexity, and cost to the backpack frame, whereas potential user's may have concern for each ounce of weight and prefer rugged, simple, low cost constructions.

In addition, the spring-loaded telescopic legs may require a specially designed backpack frame and not retrofit to the user's favorite backpack frame. Furthermore, the spring-loaded telescopic legs may not adapt to non-tubular backpack frame constructions, nor to backpack frame designs having curved vertical members.

Furthermore, the telescopic legs can be somewhat difficult to store once the user has the backpack on. The user must reach down along the sides of the backpack frame, locate and operate the spring-loaded button locks, and then push the spring-loaded legs upwardly into their storage positions. Beyond those drawbacks, the spring-loaded telescopic legs extend straight down from the backpack, and the straight-down orientation can impair stability. Thus, user's need a way to overcome the above concerns.

SUMMARY OF THE INVENTION

This invention addresses the limitations outlined above by providing a backpack frame and support pole assembly having three support poles that mount on three couplings on the backpack frame to form a tripod-like support configuration. At least two of the poles mount telescopingly on two of the couplings so that those two poles are free to fall from the couplings under influence of gravity when the backpack frame is raised. The user removes the third pole, dons the backpack frame, and then raises the frame to allow the other two poles to drop free.

The couplings add little weight to the backpack frame. The couplings and the poles add little complexity and cost.

They provide stable support. They can be included as original equipment on the backpack frame or be added to an existing prior art backpack frame. The assembly works easily and reliably, and it includes both walking-staff and bear-bag-pole features yet to be described. One embodiment (a backpack frame with integral leg couplings) includes upper and lower sections that disassemble so that the user can mount the lower section on a prior art backpack frame (i.e., one not having leg couplings) in order to use the support poles with the prior art backpack frame.

To don the backpack frame, the user first removes the third pole (also called the prop-pole), while balancing the backpack frame on the first and second poles (also called the legs). Next, he places his arms through the straps on the backpack frame so that the backpack frame rests against his back and downwardly against the first and second poles. The user then lifts the backpack frame slightly to remove the first and second poles. The poles fall free from the leg couplings under influence of gravity (sometimes with slight assistance from the user).

As an added feature, the poles in one embodiment slide together telescopically to form a walking staff. So, as the legs fall free of the couplings, the user just grasps them and slides them together. As another added feature, a separate hook member is provided that fits on one end of the third pole for use in mounting a bear bag on a tree limb.

To paraphrase some of the claim language presented in the parent application, a backpack support apparatus constructed according to the invention includes first, second, and third poles. They may, for example, take the form of two 36-inch lengths of ¾-inch outside diameter cylindrical aluminum tubing (the first and second poles) and one 72-inch length of ⅝-inch diameter cylindrical aluminum tubing (the third pole). They combine with couplings subsequently described to support the backpack frame in an upright position above a selected support surface (e.g., the ground).

First, second, and third couplings are provided for coupling respective ones of the first, second, and third poles to the backpack frame. The first coupling is adapted to be mounted on a lower right portion of the backpack frame. There, it engages an end of the first pole so that with the backpack frame in the upright position, the first pole extends downwardly and sideways to the right from the backpack frame to the support surface as a first supporting leg.

Similarly, the second coupling is adapted to be mounted on a lower left portion of the backpack frame and to engage an end of the second pole so that with the backpack frame in the upright position, the second pole extends downwardly and sideways to the left from the backpack frame to the support surface as a second supporting leg. The third coupling is adapted to be mounted on an upper portion of the backpack frame and to engage an end of the third pole so that with the backpack frame in the upright position, the third pole extends downwardly and forwardly from the backpack frame to the support surface as a third supporting leg.

According to a major aspect of the invention, the couplings do more than hold the first and second poles at an angle for better stability. They engage the ends of the first and second poles so that the first and second poles are removable from the first and second couplings when a user lifts the backpack frame upwardly. For that purpose, the couplings in one embodiment include stubs that fit loosely into the ends of the poles. When the user lifts the backpack frame, the first and second poles (the legs) disengage or fall away from the first and second couplings under influence of gravity.

To paraphrase some of the claim language presented in this continuation in part application, a backpack frame and support assembly constructed according to the invention includes a backpack frame adapted to be worn by a user in an upright position of the backpack frame. Means are provided for supporting the backpack frame in the upright position on a horizontal surface when the backpack frame is not being worn by the user. Said means includes first, second, and third poles and first, second, and third couplings for coupling the poles to the backpack frame.

The first and second couplings include first and second stubs on the lower right portion of the backpack frame that are adapted to removably engage ends of the first and second poles. The third coupling includes a third stub on the upper portion of the backpack frame that is adapted to removably engage an end of the third pole. The first and second stubs are adapted to engage the first and second poles loosely in order to enable the first and second poles to fall away from the first and second couplings under influence of gravity when the user lifts the backpack frame upwardly away from the horizontal surface. In one embodiment, the first and second couplings are integral parts of the backpack frame, and a lower portion of the backpack frame is adapted to be disassembled from an upper portion of the backpack frame in order to enable attachment of just the lower portion to a second backpack frame that does not have means for coupling the first and second poles, thereby to add the first and second stubs to the second backpack frame.

Thus, the invention provides desired attributes and increased functionality. Of course, one of ordinary skill in the art can provide couplings in any of various other forms to function as specified without departing from the broader inventive concepts disclosed. The following illustrative drawings and detailed description make the foregoing and other objects, features, and advantages of the invention more apparent.

BRIEF DESCRIPTION OF THE DRAWINGS

FIG. 1 of the drawings is a three-dimensional view of a backpack support apparatus constructed according to the invention shown installed on a typical backpack frame;

FIG. 4 is an enlarged detail view of a portion of the backpack frame and one of the attached leg couplings (the second or leftside coupling) identified by the circular arrow 4 in FIG. 1;

FIG. 5 is an enlarged view of another portion of the backpack frame and the attached prop-pole coupling (the third coupling) identified by the circular arrow 5 in FIG. 1;

FIG. 6 is a view of the assembled walking staff;

FIG. 7 is and enlarged view of a portion of the walking staff identified by the circular arrow 7 in FIG. 6;

FIG. 8 is an enlarged view of an end portion of the prop-pole, showing attachment of a hook member that adapts the prop-pole to use in mounting a bear bag over a tree limb;

FIG. 9 is an enlarged view similar to FIG. 4 that shows another embodiment of a leg coupling for the support apparatus that mounts on a horizontal backpack frame member;

FIG. 10 is a perspective view of a backpack frame constructed according to another aspect of the invention that includes first and second leg couplings as integral parts of the backpack frame;

FIG. 11 is a perspective view showing the lower portion of the backpack frame of FIG. 10 attached to another backpack frame in order to add the first and second leg couplings to the other backpack frame;

FIG. 12 is an enlarged portion of the frame of FIG. 10 attached to the other backpack frame in FIG. 11, with a different first leg coupling illustrated that is adapted to fit telescopingly over the leg instead of telescopingly within the leg;

FIG. 13 is an enlarged view similar to FIG. 5 showing the third coupling installed on the upper portion of the backpack frame of FIG. 10;

DESCRIPTION OF THE PREFERRED EMBODIMENTS

Figure 2:
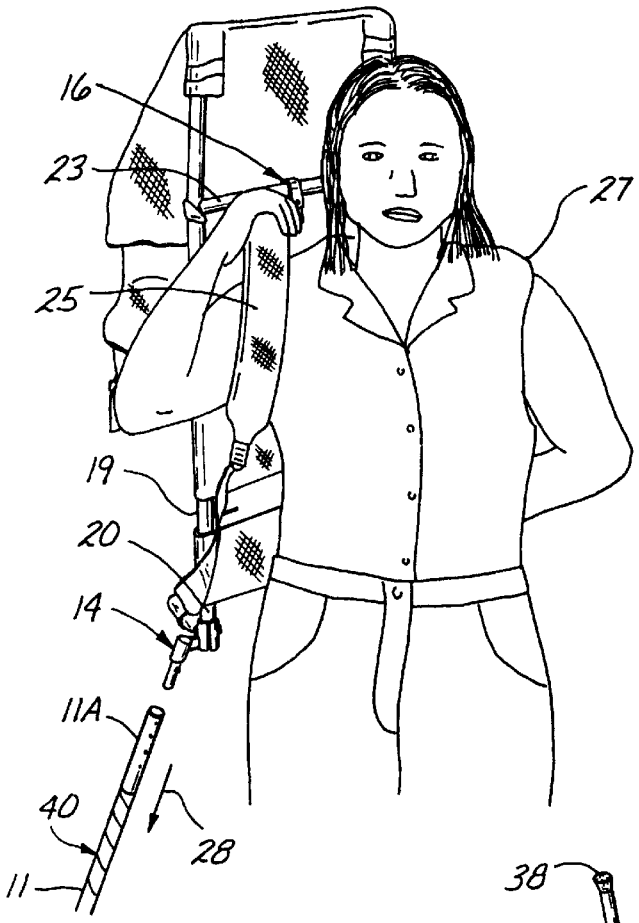
FIG. 2 is a front and right-side pictorial view showing the way in which the legs (i.e., the first and second poles) separate from the first and second couplings as a user lifts the backpack frame.

The description of the preferred embodiments begins with the description of a backpack support apparatus as set forth in the parent application that issued as U.S. Pat. No. 5,642,846. A backpack frame with integral first and second leg couplings is then described with reference to FIGS. 10 through 13, and trekking pole functionality is described with reference to FIGS. 14 and 15. A reader already familiar with the specification and FIGS. 1–9 of the parent application, may proceed directly to the description of the backpack frame with integral leg couplings.

Backpack Support Apparatus

FIG. 1 of the drawings shows a backpack support apparatus 10 constructed according to the invention. Generally, the apparatus 10 includes first, second, and third poles 11, 12, and 13, and first second and third couplings 14, 15, and 16. Those components mount on a backpack frame 17 to support the backpack frame 17 above the ground or other support surface.

A backpack support apparatus may be constructed according to the broader inventive concepts disclosed to work with any of various commercially available or specially made backpack frames on which a backpack (e.g., the backpack 18 in FIG. 1) an various other equipment may be mounted in a known manner. The illustrated backpack frame 17 includes a tubular framework of vertical and horizontal members in a known type of backpack frame configuration. Other backpack frames might use curved fiberglass or graphite members instead.

With further regard to the illustrated backpack frame 17, it includes a rightside vertical aluminum tube or member 19 that extends vertically (when the backpack frame 17 is in the upright position shown in FIG. 1) to a lower right portion 20 of the backpack frame 17. Similarly, it includes a leftside vertical aluminum tube or member 21 that extends vertically to a lower left portion 22 of the backpack frame 17. In addition, the backpack frame 17 includes a horizontal aluminum tube or member 23 that extends horizontally across an upper portion 24 of the backpack frame 17.

To further explain the orientation, the rightside member 19 occupies a position on the right of the backpack frame 17, and it is positioned toward the right of a user wearing the backpack frame 17. Similar, the leftside member 21 occupies a position on the left of the backpack frame 17, and it is positioned toward the left of a user wearing the backpack frame 17. The horizontal member 23 extends horizontally when the backpack frame 17 is worn or supported in an upright position, and the third pole 13 extends forwardly of the backpack frame 17 as illustrated in FIG. 1.

A backpack strap or just strap 25 extends from a midportion of the horizontal member 23 to the lower right portion 20 of the rightside vertical member 19, and a strap 26 extends from a mid portion of the horizontal member 23 to the lower left portion 22 of the leftside vertical member 21. A user dons the backpack frame 17 by placing the straps 25 and 26 over the user's shoulders in a known way. That mounts the backpack frame 17 on the user's back and shoulders.

The three poles 11–13 and the three couplings 14–16 support the backpack frame 17 when it is not on the user's back. For that purpose, each of the first, second, and third couplings 14–16 removably couples a respective one of the first, second, and third poles 11–13 to the backpack frame 17.

The first coupling 14 is adapted to be mounted on the lower right portion 20 of the backpack frame 17 and to engage a first end portion 11A of the first pole 11. Coupled to the backpack frame 11 that way and with the backpack frame 17 in the upright position illustrated in FIG. 1, the first pole 11 extends downwardly and sideways to the right from the backpack frame 17 to the ground as illustrated in FIG. 1. A second end portion 11B of the first pole 11 sets upon the ground, with the first pole 11 serving as a first supporting leg.

Similarly, the second coupling 15 is adapted to be mounted on the lower left portion 22 of the backpack frame 17 and to engage an first end portion 12A of the second pole 12. The second pole 12 extends downwardly and sideways to the left from the backpack frame 17 to the ground. A second end portion 12B of the second pole 12 sets upon the ground, with the second pole 12 serving as a second supporting leg.

The third coupling is adapted to be mounted on the upper portion 24 of the backpack frame 17 and to engage a first end portion 13A of the third pole 13. The third pole 13 extends downwardly and forwardly from the backpack frame 17 to the ground. A second end portion 13B of the third pole 13 sets upon the ground, with the third pole 13 serving as a third supporting leg.

Figure 3:
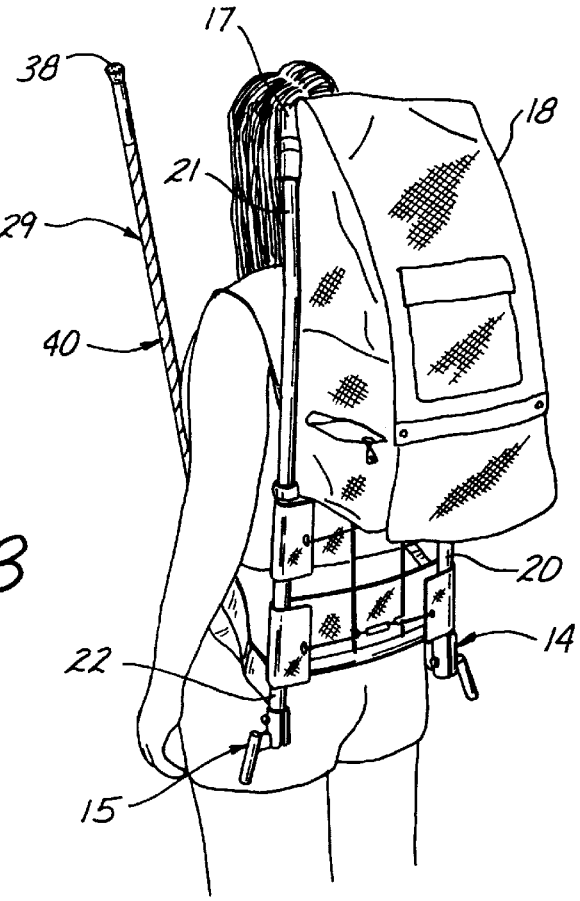
FIG. 3 is a rear and left-side pictorial view showing the backpack frame fully in place on the user and the legs assembled with the prop-pole (i.e., the third pole) into a walking staff.

In addition to holding the first and second poles 11 and 12 so that the first pole 11 angles outwardly to the right and the second pole 12 angles outwardly to the left of the backpack frame 17 for better stability, the first and second couplings 14 and 15 enable convenient removal of the first and second poles 11 and 12 when the backpack frame 17 is put on the user's back as depicted in FIG. 2. The user 27 in FIG. 2 places her arms through the straps 25 and 26 (only the strap 25 is visible in FIG. 2). She may crouch slightly to do that, depending on her height. When she has her right arm through the strap 25 and her left arm through the strap 26, she straights up slightly to lift the backpack frame 17 from the first and second poles 11 and 12. As she does so, the first and second poles 11 and 12 fall from the first and second couplings 14 and 15, as depicted in FIG. 2 by the pole 11 falling free from the coupling 14 in the direction of an arrow 28. She then assembles the first, second, and third poles 11, 12, and 13 into a walking staff 29 (FIG. 3).

The first and second couplings 14 and 15 are similar and so only the coupling 15 is described in further detail with reference to FIG. 4. The coupling 15 includes first and second clamp members 30 and 31. Each one-half of a two-inch long steel sleeve that has been cut longitudinally into the two members 30 and 31. The two members 30 and 31 are drilled with ¼-inch holes ½-inch from an upper end and otherwise adapted to be mounted on the lower end portion 22 of the leftside vertical member 21 with a bolt-and-nut combination 32. The first and second clamp members 30 and 31 are suitably sized to fit the particular backpack frame intended. Of course, one of ordinary skill in the art can vary the composition and precise configuration without departing from the inventive concepts disclosed.

The first clamp member 30 of the second coupling 15 includes a welded-on bracket member 33 (e.g., a one-inch long section of ¼-inch thick steel strap) from which a three-inch long cylindrical stub 34 extends at approximately 105-degrees from horizontal. In other words, the longitudinal axis of the stub 34 angles outwardly from the backpack frame 17 (when the backpack frame 17 is in an upright position) approximately 15-degrees from a line extending straight down (angle A in FIG. 4). That angles the stub 34 and axially aligned second pole 12 outwardly away from the backpack frame 17.

The stub 34 has an outside diameter that fits loosely within the first end portion 12A of the second pole 12. The first and second poles 11 and 12 are three-foot lengths of ¾-inch outside diameter aluminum tubing having an inside diameter just slightly greater than ⅝-inch, and so the stub 34 has a ⅝-inch outside diameter. That enables the pole 12 to fall free from the coupling 15 when the user lifts the backpack frame 17 sufficiently to remove weight from the pole 12.

One or more ¼-inch holes 35 are provided in the first end portion 12A of the second pole 12 and the first end portion 11A of the first pole 11. The holes 35 receive spring-loaded button lock mechanisms 36 and 37 on the third pole 13 (FIGS. 1, 6, and 7) when the three poles 11, 12, and 13 are assembled into the walking staff 29 (FIGS. 3, 6, and 7). The button lock mechanisms 36 and 37 are located about two inches from the end of the third pole 13. Standard ¾-inch rubber tips 38 and 39 (such as used on a crutch or on the leg of an aluminum walker) are included on the second end portions 11B and 12B of the first and second poles 11 and 12 (FIGS. 1, 3, and 7). In addition, the second end portions 11B and 12B may be tapped and outfitted with threaded steel plugs (not shown). Such one-inch long steel plugs or pipe nipples are screwed into the lower ends of the first and second poles 11 and 12 in order to reinforce the ends. Plastic-tape-covered areas, or foam handgrip members such as are used on bicycles handlebars, are included on the exterior of the first and second poles 11 and 12 (as depicted in at numeral 40 in FIGS. 1–3 and 6) for enhancing the user's grip of the walking staff 29.

Further details of the third coupling are shown in FIG. 5. It includes a first, second, and third members 41, 42, and 43 that fit together telescopically and attach to the horizontal member 23 with a ½-inch wide by 3.5-inch long 22 gauge aluminum strap 44 and a one-inch long, 3/16-inch diameter nut-and-bolt combination 45. The first member 41 is a one-inch long section of ¾-inch outside diameter aluminum tubing. The second member 42 is a two-inch long section of ⅝-inch outside diameter aluminum tubing, one inch of which is within the first member 41. The third member is a three-inch long section of ½-inch aluminum tubing, two inches of which are within the second member 42.

The nut-and-bolt combination 45 extends through the strap 44 as well as all three of the members 41, 42, and 43

(FIG. 5). A 3/16-inch hole is drilled through the members 41, 42, and 43 for that purpose. With the third coupling 16 mounted on the horizontal member 23 of the backpack frame 17, the third member 43 fits loosely into the end portion 13A of the third pole 13. The end portion 13A of the third pole 13 then abuts the second member 42.

In some situations, the user may desired to prop the backpack frame 17 in an upright position when the backpack frame 17 is resting directly on the ground without the first and second poles 11 and 12. In that case, the user uses the coupling 16 to couple either the first pole 11 or the second pole 12 to the backpack frame 17 as a prop-pole. The ⅝-inch outside diameter of the second member 42 fits loosely into the ¾-inch outside diameter first and second poles 11 and 12 for that purpose, with the end of the first or second pole then abutting the first member 41 of the coupling 16.

With the third pole 13 and the first and second poles 11 and 12 removed from the backpack frame 11, the user can assemble them into the walking staff 29 shown in FIG. 6. As illustrated in the enlarged detail view of FIG. 7, the third pole 13 takes the form of two 36-inch long sections of ⅝-inch outside diameter tubing that each have one end tapped. The two tapped ends are joined together with a one-inch long, ¼-inch diameter, threaded steel pipe nipple 46. To assemble the walking staff 29, the user slides the first and second poles 11 and 12 over the third pole 13 until the button lock mechanism 36 snaps into a hole 35 in the first pole 11 and the button lock mechanism 37 snaps into a hole 35 in the second pole 12.

FIG. 8 illustrates a hook member 50 that can be used with the third pole 13. The hook member 50 includes a hook 51 made of ¼-inch diameter steel that is welded to a 1.5-inch long section of ⅝-inch outside diameter hollow tubing 52. A spring-loaded button lock mechanism 53 is included on the tubing 52, ½-inch back from the end. The tubing 52 fits into the end of the third pole 13, with the button lock mechanism 53 snapping into a ¼-inch diameter hole 54 in the first end portion 13A end of the third pole 13.

FIG. 9 shows a second embodiment of a leg coupling for the support apparatus that mounts on a horizontal backpack frame member. It is designated in FIG. 9 as a coupling 115, and it is attached to a lower left portion 122 of a lower horizontal member 160 of a backpack frame 117. There, it couples the first end portion 12A of the second pole 12 to the lower left portion 122 of the backpack frame 117. The coupling 115 is similar in some respects to the second coupling 15 illustrated in FIG. 4 and only differences are described in further detail. For convenience, reference numerals designating parts of the coupling 115 are increased by one hundred over those designating corresponding parts of the coupling 15.

The major difference is that the coupling 115 is adapted to mount on the lower horizontal member 160, instead of a vertical member. That is important because the vertical member on some backpack frames are inaccessible or improperly shaped for a coupling such as the coupling 15 previously described. A ⅝-inch outside diameter stub 134 is welded to a first half-sleeve member 130 so that the stub extends downwardly and outwardly at a 105 degree angle from the horizontal member 160 when the first half-sleeve member 130 and a second half-sleeve member 131 are mounted on the lower horizontal member 160 with a nut-and-bolt combination 132.

Thus, the invention provides first, second, and third poles and first, second, and third couplings that removably couple the poles to a backpack frame to form a tripod-like support configuration. The poles angle away from the backpack frame advantageously for improved stability and the couplings removably engage the poles so that the poles may be removed easily by lifting the backpack frame.

The apparatus adds little weight to the backpack frame. It adds little complexity and cost. It provides stable support. It can be included as original equipment or be added to an existing backpack frame. It works easily and reliably, and it includes handy walking-staff and bear-bag-pole features.

Although exemplary embodiments have been shown and described, one of ordinary skill in the art may make many changes, modifications, and substitutions without necessarily departing from the spirit and scope of the invention. For example, couplings may be welded or otherwise attached to the backpack frame. Furthermore, a backpack frame may be constructed with vertical and/or horizontal backpack frame members that include couplings that are part of the backpack frame members.

Backpack Frame With Integral Leg Couplings

FIG. 10 shows a backpack frame 200 constructed according to the invention with first and second leg couplings 214 and 215 that are integral parts of the backpack frame 200. The leg couplings 214 and 215 are not optional additions to the backpack frame 200. They are fabricated as permanent parts of the backpack frame.

Any of various backpack frame constructions may be utilized without departing from the inventive concepts disclosed, so long as it includes two leg couplings that function as described. The illustrated backpack frame 200 is constructed mainly of aluminum and steel tubing. It includes an upper portion 260 having an upper rightside member 261, an upper leftside member 262, and an upper horizontal member 263 (FIG. 10). It also includes a lower portion 264 having a lower rightside member 265, a lower leftside member 266, a lower horizontal member 267, and the first and second couplings 214 and 215. As an additional matter of terminology, the first coupling may be said to be on a lower right portion of the lower portion 264, and the second coupling 215 may be said to be on a lower left portion.

The upper rightside and upper leftside members 261 and 262 of the upper portion 260 are fabricated from 24-inch long sections of ½-inch outside diameter (O.D.) aluminum tubing in which the illustrated ninety-degree bends have been formed. With the backpack frame 200 in an upright backpack frame position, the members 261 and 262 extend vertically along right and left sides of the backpack frame 200 and then horizontally up to and telescopingly within the upper horizontal member 263. The member 263 is a 10-inch length of ⅝-inch aluminum tubing, and the members 261 and 262 are connected to it by bolting or other suitable means. The members 261, 262, and 263 may be provided with multiple 3/16-inch bolt holes spaced one inch apart to enable adjustment of the width of the backpack frame 200 (i.e., the horizontal distance between vertically extending portions of the upper rightside and upper leftside members 261 and 262). The members 261 and 262 are bolted to the upper horizontal member 263 using appropriate ones of the holes to achieve a desired width (e.g., 15–20 inches wide).

The lower rightside member 265 and the lower leftside member 266 are each a 18-inch long section of ⅝-inch O.D. aluminum tubing. The lower horizontal member 267 is a 12-inch long section of ⅝-inch aluminum tubing that has been bent to form a 150-degree angle in the member 267. The first and second couplings 214 and 215 are formed from steel tubing welded into the illustrated configurations so that they fit telescopingly into the members 265, 266, and 267 as illustrated in FIG. 10. Those components of the lower portion 264 are connected together in the illustrated configuration by bolting or other suitable means. They may be provided with multiple 3/16-inch bolt holes spaced one inch apart to enable adjustment of the width of the backpack frame 200 as well as the height of the backpack frame 200 (i.e., the vertical distance between the upper and lower horizontal members 263 and 267).

The first coupling 214 (the right leg coupling) includes a first stub 214A that is adapted to removably engage an end of the first pole 11 that was described previously with reference to FIGS. 1–9. The stub 214A may take the form of a three-inch long cylindrical stub and otherwise be similar in size and angular deployment to the stub 34 described previously with reference to FIGS. 1–9 It engages the first pole 11 with the backpack frame 200 in the upright position so that the first pole 11 extends downwardly and sidewardly away from the lower portion 264 of the backpack frame 200 to a horizontal surface (e.g., the ground) as a first supporting leg.

Similarly, the second coupling 215 (the left leg coupling) includes a second stub 215A that is adapted to removably engage an end of the second pole 12 that was described previously with reference to FIGS. 1–9. The stub 215A may also take the form of a three-inch long cylindrical stub and otherwise be similar in size and angular deployment to the stub 34 described previously with reference to FIGS. 1–9 It engages the second pole 12 with the backpack frame 200 in the upright position so that the second pole 12 extends downwardly and sidewardly away from the lower portion 264 of the backpack frame 200 to the ground or other horizontal surface as a second supporting leg.

In addition to the foregoing components, the backpack frame 200 may be provided with the cross members 268A–C illustrated in phantom lines in FIG. 10. Furthermore, four rubber sleeves 270A through 270D may be included over the members 265 and 266 to space the lower portion 264 from another backpack frame 271 having no stubs when the lower portion 264 is attached to it as shown in FIG. 11 in order to add stubs to the other backpack frame 271. In other words, the user unbolts the upper portion 260 from the lower portion 264 and then connects the lower portion 264 to the other backpack frame 271 with bolts (e.g., the nut and bolt combination 272 shown in FIG. 12). Ties 273 and 274 in FIG. 11 made from lengths of cord (or other suitable attachment means) may also be used to secure the lower portion 264 to the other backpack frame 271.

FIG. 12 also serves to illustrate a different leg coupling 314. It is similar in many respects to the first coupling 214. The major difference is that the stub 314A is a hollow tube into which a pole 311 fits telescopingly as a first or rightside leg. The pole 311 fits into the stub 314A, unlike the stub 214A that fits into the pole 11. The pole 311 may be a solid rod, just as the stub 214A may be a solid rod. One advantage of having the stub fit into the pole is that a hollow stub can fill with dirt during use, and that situation can make it difficult to inset the pole into the stub. The illustrated stubs and poles are cylindrically shaped. Other shapes, including square tubes, can be used without departing from the broader inventive concepts disclosed.

FIG. 13 shows the third pole 13 coupled to the backpack frame 200. For that purpose, the third coupling 16 described previously with reference to FIGS. 1–9 is attached to the upper horizontal member 263. The third coupling 16 engages the first end portion 13A of the third pole 13. The third pole 13 extends downwardly and forwardly from the backpack frame 200 to the ground or other surface. In using the lower portion 264 with the other backpack frame 271 shown in FIG. 11, the third coupling 16 is attached to a horizontal member 275 on the other backpack frame 271.

Trekking Poles

Figure 14:
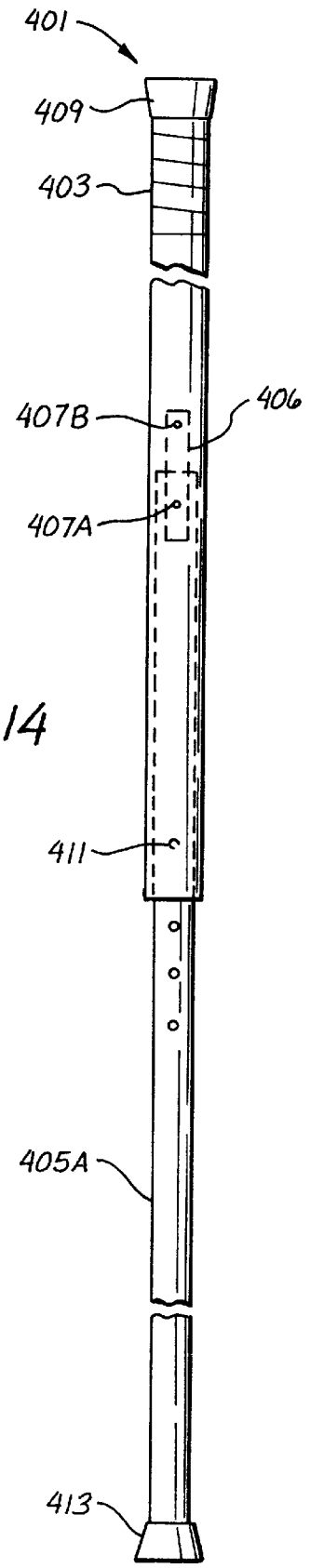
FIGS. 14 and 15 are enlarged views of first and second trekking poles showing how suitably configured first, second, and third support poles slide together to form two trekking poles instead of one walling staff.
Figure 15:
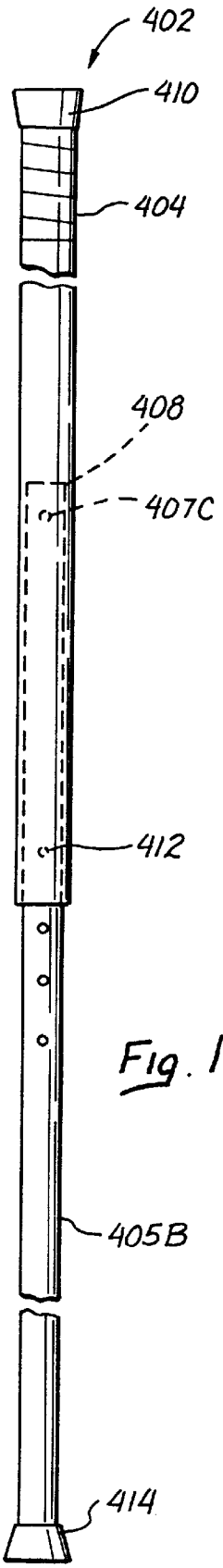

Now consider FIGS. 14 and 15. They are enlarged views of first and second trekking poles 401 and 402 formed by sliding first and second support poles 403 and 404 telescopingly over first and second sections 405A and 405B of a third support pole. The first and second support poles 403 and 404 are counterparts of the poles 11 and 12 described previously, while the first and second sections 405A and 405B are counterparts of the two sections that assemble together into the third support pole 13 (i.e., the prop-pole).

The first and second sections 405A and 405B are each a length of 5/8-inch outside diameter aluminum tubing. A stub 406 of ½-inch outside diameter aluminum tubing is secured to the first section 405A using a third spring-loaded button lock mechanism 407A on the stub (FIG. 14). To assemble the first and second sections 405A and 405B together to form the third pole, the user removes the first and section sections from the trekking poles 401 and 402 and then slides the stub 406 into the end portion 408 (FIG. 15) of the second section 405B so that a fourth spring-loaded button lock mechanism 407B on the stub 406 engages a hole 407C in the second section 405B. That forms the third pole and readies it for use in propping up the backpack frame.

The first and second support poles 403 and 404 are each a three-foot length of ¾-inch outside diameter aluminum tubing. Conventional ¾-inch rubber tips 409 and 410 are included on one end of each pole. Grip tape or foam grips may also be included. First and second spring-loaded button lock arrangements 411 and 412 secure the sections 405A and 405B within the support poles 403 and 404 while enabling the user to easily disassemble the trekking poles 401 and 402 when desired.

Additional 5/8-inch rubber tips 413 and 414 are provided on the first and second sections 405A and 405B. The user simply removes one of the rubber tips 413 and 414 before using the first and second sections 405A and 405B together as the third support pole, so that the third support pole can be secured to the third coupling 16 on the backpack frame. The removed rubber tip is replaced before again using the trekking poles 401 and 402. An alternate third coupling (not shown) includes a two-inch length of 1.125-inch OD aluminum tubing that fits over the rubber tip so that the rubber tip need not be removed. If desired, the user can remove both of the tips 413 and 414 and assemble the three support poles into a walking staff as discussed previously.

Recapitulating, the new material added by this continuation-in-part application focuses primarily on a backpack frame having integral first and second leg couplings. The illustrated backpack frame 200 is so configured, and it combines with the third coupling 16 and the poles 11, 12, and 13 to form what is referred to herein as a backpack frame and support assembly. Attaching the separable lower portion 264 of the backpack frame 200 to another backpack frame illustrates another way, of using the invention with an existing backpack frame that has no leg couplings. In addition, properly configured support poles are disclosed that assemble into two trekking poles 401 and 402 for even greater functionality.

What is claimed is:

1. A backpack frame and support assembly, comprising:

a backpack frame having a lower right portion a lower left portion and an upper portion;

means in the form of first, second, and third poles for supporting the backpack frame in an upright position above a selected support surface; and means in the form of first, second, and third couplings for removably coupling respective ones of the first, second, and third poles to the backpack frame;

wherein the first coupling is part of the lower right portion of the backpack frame that is adapted to engage an end of the first pole with the backpack frame in the upright position so that the first pole extends downwardly and sideways to the right from the backpack frame to the support surface as a first supporting leg;

wherein the second coupling is part of the lower left portion of the backpack frame that is adapted to engage an end of the second pole with the backpack frame in the upright position so that the second pole extends downwardly and sideways to the left from the backpack frame to the support surface as a second supporting leg;

wherein the third coupling is adapted to be mounted on an upper portion of the backpack frame and to engage an end of the third pole with the backpack frame in the upright position so that the third pole extends downwardly and forwardly from the backpack frame to the support surface as a third supporting leg;

wherein the first coupling is adapted to engage the end of the first pole and the second coupling is adapted to engage the end of the second pole so that the first and second poles are removable from the first and second couplings when a user removes weight from the first and second poles by lifting the backpack frame upwardly;

wherein the first coupling includes a first stub adapted to loosely engage the end of the first pole and the second coupling includes a second stub adapted to loosely engage the end of the second pole so that the first and second poles are free to fall away from the first and second couplings under influence of gravity when the user removes weight from the first and second poles by lifting the backpack frame upwardly; and wherein the first and second stubs are adapted to fit loosely into the ends of the first and second poles.

2. An apparatus as recited in claim 1, wherein the first and second poles are hollow cylindrical tubes and the first and second stubs are cylindrically shaped members adapted to fit loosely into the ends of the first and second poles.

3. An apparatus as recited in claim 1, wherein the first, second, and third poles are adapted to be joined together to form a walking staff.

4. An apparatus as recited in claim 1, further comprising a hook member adapted to be attached to the third pole.

5. A backpack frame and support assembly, comprising:

a backpack frame having a lower right portion, a lower left portion, and an upper portion;

means in the form of first, second, and third poles for supporting the backpack frame in an upright position above a selected support surface; and means in the form of first, second, and third couplings on respective ones of a lower right portion, a lower left portion, and an upper portion of the backpack frame for removably coupling respective ones of the first, second, and third poles to the backpack frame;

wherein the first coupling is part of the lower right portion of the backpack frame and adapted to engage an end of the first pole with the backpack frame in the upright position so that the first pole extends downwardly and sideways to the right from the backpack frame to the support surface as a first supporting leg;

wherein the second coupling is part of the lower left portion of the backpack frame and adapted to engage an end of the second pole with the backpack frame in the upright position so that the second pole extends downwardly and sideways to the left from the backpack frame to the support surface as a second supporting leg;

wherein the third coupling is adapted to couple an end of the third pole to the upper portion of the backpack frame with the backpack frame in the upright position so that the third pole extends downwardly and forwardly from the backpack frame to the support surface as a third supporting leg;

wherein the first coupling is adapted to engage the end of the first pole and the second coupling is adapted to engage the end of the second pole so that the first and second poles are removable from the first and second couplings when a user removes weight from the first and second poles by lifting the backpack frame upwardly; and wherein the first coupling includes a first stub adapted to loosely engage the end of the first pole and the second coupling includes a second stub adapted to loosely engage the end of the second pole so that the first and second poles are free to fall away from the first and second couplings under influence of gravity when the user removes weight from the first and second poles by lifting the backpack frame upwardly; and wherein the first and second stubs are adapted to fit loosely into the ends of the first and second poles.

6. A backpack frame and support assembly, comprising:

a backpack frame, the backpack frame having an upper portion and a lower portion, and the backpack frame being adapted to be worn by a user in an upright position of the backpack frame; and means for supporting the backpack frame in the upright position on a horizontal surface when the backpack frame is not being worn by the user, said means including first, second, and third poles and first, second, and third couplings for coupling the poles to the backpack frame;

the first coupling including a first stub on the lower portion of the backpack frame that is adapted to removably engage an end of the first pole with the backpack frame in the upright position so that the first pole extends downwardly and sidewardly away from the lower portion of the backpack frame to the horizontal surface as a first supporting leg;

the second coupling including a second stub on the lower portion of the backpack frame that is adapted to removably engage an end of the second pole with the backpack frame in the upright position so that the second pole extends downwardly and sidewardly away from the lower portion of the backpack frame to the horizontal surface as a second supporting leg; and the third coupling including a third stub on the upper portion of the backpack frame that is adapted to removably engage an end of the third pole with the backpack frame in the upright position so that the third pole extends downwardly and away from the backpack frame to the horizontal surface as a third supporting leg;

wherein the first and second stubs are adapted to engage the first and second poles loosely in order to enable the first and second poles to fall away from the first and second couplings under influence of gravity when the user lifts the backpack frame upwardly away from the horizontal surface.

7. An assembly as recited in claim 6, wherein the first and second couplings are integral parts of the backpack frame.

8. An assembly as recited in claim 6, wherein the first, second, and third poles are adapted to be joined together to form a walking staff.

9. An assembly as recited in claim 6, wherein the first and second poles are hollow tubes and the first and second stubs are adapted to fit loosely into the ends of the first and second poles.

10. An assembly as recited in claim 9, wherein the first and second poles are cylindrically shaped tubes and the first and second stubs cylindrically shaped solid rods.

11. An assembly as recited in claim 6, wherein the first and second stubs are hollow tubes and the first and second poles are cylindrically shaped members adapted to fit loosely into the ends of the first and second stubs.

12. An assembly as recited in claim 6, wherein the first and second stubs are adapted to be attached to a selected backpack frame that does not have means for coupling the first and second poles to the selected backpack frame.

13. An assembly as recited in claim 6, wherein the lower portion of the backpack frame is adapted to be disassembled from the upper portion of the backpack frame in order to enable attachment of just the lower portion to a second backpack frame that does not have means for coupling the first and second poles to the second backpack frame, thereby to add the first and second stubs to the second backpack frame.

14. An assembly as recited in claim 6, wherein the first, second, and third poles are adapted to be joined together to form two trekking poles.

* * * * *